US010813479B2

(12) United States Patent
Gupta

(10) Patent No.: US 10,813,479 B2
(45) Date of Patent: Oct. 27, 2020

(54) FITTED SHEET WITH IMPROVED GRIPPING EFFECT

(71) Applicant: Trident Limited, Sanghera (IN)

(72) Inventor: Abhishek Gupta, Barnala (IN)

(73) Assignee: Trident Limited (IN)

( * ) Notice: Subject to any disclaimer, the term of this patent is extended or adjusted under 35 U.S.C. 154(b) by 219 days.

(21) Appl. No.: 16/035,864

(22) Filed: Jul. 16, 2018

(65) Prior Publication Data

US 2019/0365122 A1 Dec. 5, 2019

(30) Foreign Application Priority Data

Jun. 1, 2018 (IN) ..... 201811020612

(51) Int. Cl.
*A47G 9/02* (2006.01)

(52) U.S. Cl.
CPC ..... *A47G 9/0246* (2013.01)

(58) Field of Classification Search
CPC . A47G 9/0246; B60J 7/10; B60J 7/102; B60J 7/104; E04H 15/64; A47D 15/02
USPC ..... 135/119
See application file for complete search history.

(56) References Cited

U.S. PATENT DOCUMENTS

| | | | | |
|---|---|---|---|---|
| 4,662,013 | A * | 5/1987 | Harrison | A47G 9/0246 5/497 |
| 5,029,353 | A | 7/1991 | Kimball et al. | |
| 5,263,212 | A * | 11/1993 | Garcia | A47G 9/0246 5/496 |
| 6,983,500 | B2 | 1/2006 | Wootten | |
| 8,438,679 | B2 * | 5/2013 | Wootten, Jr. | A47G 9/0246 5/482 |
| 8,707,482 | B1 * | 4/2014 | Ramthun | A47G 9/0246 5/496 |
| 9,259,107 | B2 | 2/2016 | Lilienthal | |
| 2008/0263768 | A1 | 10/2008 | Balasundharam | |
| 2016/0360905 | A1 | 12/2016 | Feldman | |

* cited by examiner

*Primary Examiner* — Eric J Kurilla
*Assistant Examiner* — James T Coble
(74) *Attorney, Agent, or Firm* — Lerner, David, Littenberg, Krumholz & Mentlik, LLP

(57) ABSTRACT

A fitted sheet and a gripping element integrable with fitted sheets is provided. The fitted sheet comprises an elastic band and a plurality of gripping elements secured to a surface of the fitted sheet. Each gripping element comprises a horizontal elastic strip and an inverted V shaped elastic segment attached to the horizontal elastic strip. At least two arms of the inverted V shaped segment are attachable diagonally along the surface of the sheet respectively. The horizontal elastic strip is extendable laterally along a surface of the fitted sheet. The resultant force generated by the elastic band and the plurality of gripping elements enhances gripping of the fitted sheet and prevents crumpling and dog ear formation during usage.

11 Claims, 3 Drawing Sheets

| At stretched state of fitted sheet | | | | | |
|---|---|---|---|---|---|
| Sr. no | Drop of sheet (cm) | Mattress thickness (cm) | AC (cm) | BC (cm) | Θ (°) |
| 1 | 50.8 | 40.64-50.8 | 36 | 34 | 71 |
| 2 | 45.72 | 35.56-45.72 | 30 | 28 | 69 |
| 3 | 40.64 | 30.48-40.64 | 25 | 23 | 67 |
| 4 | 35.56 | 25.4-35.56 | 21 | 18 | 59 |
| 5 | 30.48 | 20.32-30.48 | 18 | 12 | 42 |

Table 1

FIG. 3

FITTED SHEET WITH IMPROVED GRIPPING EFFECT

FIELD OF THE INVENTION

The present invention relates, generally, to bed linen, and more particularly to fitted sheets with improved gripping effect.

BACKGROUND OF THE INVENTION

Generally, a fitted sheet includes a top panel and side panels that extend from edges of the top panel. The top panel is sized to cover the top surface of a mattress and side panels are sized to cover the side surfaces of the mattress such that a portion of the side panels may be tucked underneath the mattress and held in place by elastic bands.

However, it has been observed that the top panels of the existing fitted sheets gets crumpled during usage. Also, due to lack of proper gripping at the corners of the sheet, dog ears or seam ears are formed leading to poor aesthetics. Further, the existing fitted sheet do not fit well on mattresses of varying thicknesses. Yet further, fitting of the existing fitted sheet deteriorates after several washes due to loosening of the elastic bands.

In light of the aforementioned drawbacks, there is a need for a fitted sheet which provides enhanced fitting and prevents crease formation at the top panel of the sheet during usage. Further, there is a need for a fitted sheet which provides enhanced gripping at the corners of the sheet and prevents dog ear or seam ear formation. Furthermore, there is a need to provide a fitted sheet which can accommodate mattresses of varying thicknesses. Yet further, there is a need for a fitted sheet, such that fitting of the sheet does not deteriorate after several washes.

SUMMARY OF THE INVENTION

In accordance with various embodiments of the present invention, a fitted sheet (100) for mattresses (102) is provided. The fitted sheet (100) comprises a top panel (104) and a plurality of side panels (106). The side panels (106) extend contiguously along a periphery (104*a*) of the top panel (104). The top panel (104) and the plurality of side panels (106) define an open ended body including a plurality of corners (108) formed by edges of the top panel (104) and two adjacent side panels (106). Each of the plurality of side panels (106) include an elastic band (110) extending along the respective side panels (106), and a plurality of gripping elements (112) secured to each of the plurality of corners (108), respectively, such that a portion (112*a*) of the gripping element (112) is engageable with one side panel (106) and other portion (112*b*) of the gripping element (112) is engageable with the adjacent side panel (106). Further, each gripping element (112) comprises a horizontal elastic strip (114) and an inverted V shaped elastic segment (116) attached to the horizontal elastic strip (114). Each horizontal elastic strip (114) extends laterally along the corresponding adjacent side panels (106). Furthermore, at least two arms (116*a*, 116*b*) of the inverted V shaped segment 116 are disposed diagonally along the side panels (106), respectively, and are disposed at an angle (θ) in relation to the horizontal elastic strip (114). A midpoint (114*c*) of the horizontal elastic strip (114) is in line with a vertex (C) of the inverted V elastic segment (116) dividing the gripping element (112) into the two portions (112*a*, 112*b*). Each of the plurality of gripping elements (112) and the one or more elastic bands 110 exerts horizontal and vertical forces such that the resultant forces cause an increase in gripping effect and prevents the fitted sheet (100) from crumpling.

In accordance with various embodiments of the present invention, a gripping element (112) is provided. Each gripping element (112) comprises an horizontal elastic strip (114) and an inverted V shaped elastic segment (116) attached to the horizontal elastic strip (114). Each horizontal elastic strip (114) extendable laterally along a surface and at least two arms (116*a*, 116*b*) of the inverted V shaped segment 116 are disposed diagonally along the surface at an angle (θ) in relation to the horizontal elastic strip (114). Further, a midpoint (114*c*) of the horizontal elastic strip (114) is in line with a vertex (C) of the inverted V shaped elastic segment (116) dividing the gripping element (112) into two portions (112*a*, 112*b*). The gripping element (112) exerts horizontal and vertical forces which cause an increase in gripping effect.

BRIEF DESCRIPTION OF THE DRAWINGS

The present invention is described by way of embodiments illustrated in the accompanying drawings wherein:

FIG. 3 illustrates a (Table 1) depicting varying drop values of the fitted sheet for varying thickness values of the mattresses, in accordance with an embodiment of the present invention.

DETAILED DESCRIPTION OF THE INVENTION

The present invention provides a fitted sheet and a gripping element integrable with fitted sheets and the like. In accordance with various embodiments of the present invention, the fitted sheet comprises an elastic band and a plurality of gripping elements secured at the surface of the fitted sheet. Each gripping element comprises a horizontal elastic strip and an inverted V shaped elastic segment attached to the horizontal elastic strip. The at least two arms of the inverted V are attachable diagonally along the surface of the sheet respectively. The horizontal elastic strip is extendable laterally along a surface of the fitted sheet. The at least two arms of the inverted V shaped elastic segment are disposed at an angle (θ) in relation to the horizontal elastic strip. A midpoint of the horizontal elastic strip is in line with a vertex (C) of the inverted V segment dividing the gripping element into two portions. The resultant force generated by the elastic band and the plurality of gripping elements enhances gripping of the fitted sheet and prevents crumpling and dog ear or seam ear formation during usage.

The disclosure is provided in order to enable a person having ordinary skill in the art to practice the invention. Exemplary embodiments herein are provided only for illustrative purposes and various modifications will be readily apparent to persons skilled in the art. The general principles defined herein may be applied to other embodiments and applications without departing from the spirit and scope of the invention. The terminology and phraseology used herein is for the purpose of describing exemplary embodiments and should not be considered limiting. Thus, the present invention is to be accorded the widest scope encompassing numerous alternatives, modifications and equivalents consistent with the principles and features disclosed herein. For purposes of clarity, details relating to technical material that is known in the technical fields related to the invention have been briefly described or omitted so as not to unnecessarily obscure the present invention.

It is to be noted that, as used in the specification by the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

The present invention would now be discussed in context of embodiments as illustrated in the accompanying drawings.

Figures 1A, 1B, 1C:
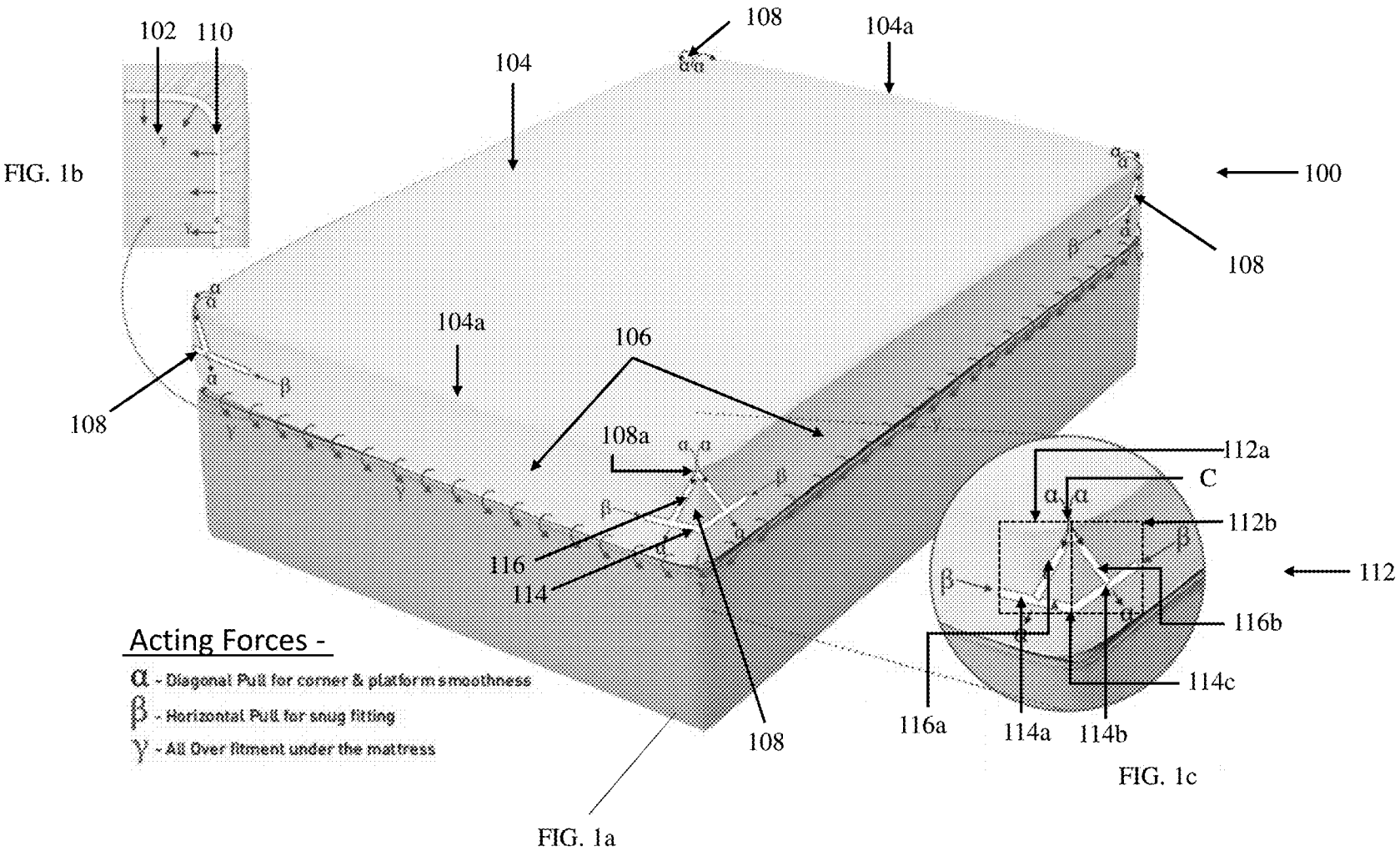
FIG. 1*a* is a perspective view of a fitted sheet, in accordance with an embodiment of the present invention.
FIG. 1*b* is an enlarged view of a bottom portion of the fitted sheet, in accordance with an embodiment of the present invention.
FIG. 1*c* is an enlarged view of a corner of the fitted sheet comprising a gripping element, in accordance with an embodiment of the present invention.

FIG. 1*a* is a perspective view of a fitted sheet, in accordance with an embodiment of the present invention. FIG. 1*b* is an enlarged view of a bottom portion of the fitted sheet, in accordance with an embodiment of the present invention. FIG. 1*c* is an enlarged view of a corner of the fitted sheet comprising a gripping element, in accordance with an embodiment of the present invention.

In an embodiment of the present invention, the fitted sheet 100 is configured to accommodate a mattress 102. The mattress 102 may have a variable thickness. In an exemplary embodiment of the present invention, thickness range of the mattress may include, but is not limited to, 9 inch to 22 inches. In various embodiments of the present invention the mattress 102 may be of any suitable shape such as rectangular, hexagonal, polygonal or any other suitable shape. As illustrated in FIG. 1*a*, the fitted sheet 100 comprises a top panel 104 and a plurality of side panels 106. The top panel 104 may have a shape that corresponds to a top portion of the mattress 102. Referring to FIG. 1*a*, in an embodiment of the present invention, the top panel 104 is rectangular in shape. The top panel 104 is sized so that the top of the mattress 102 may be substantially covered by the top panel 104. The side panels 106 extend contiguously along a periphery 104*a* of the top panel 104. The top panel 104 and the plurality of side panels 106 define an open ended body including a plurality of corners 108. Each corner 108 is formed by edges along the periphery of the top panel 104 and two adjacent side panels 106. In the exemplary embodiment of the present invention, the fitted sheet 100 comprises four corners 108. As illustrated in FIG. 1*b*, each of the plurality of side panels 106 include an elastic band 110 extending along the respective side panels 106. In particular, the elastic band 110 is attached along the lower edges of the respective side panel 106. In an exemplary embodiment of the present invention, the elastic band 110 may be of superior quality such as a booster elastic band and having an elasticity of 200 percent. The elastic band may be prepared using woven technology or may be knitted. The high elasticity of the elastic band 110 makes it durable and strong. In another embodiment of the present invention, the elastic band 110 is heat set and has an elongation ranging from 150% to 250%. The horizontal elastic band 110 exerts a horizontal force (γ) along respective side panels 106. In an exemplary embodiment of the present invention, the elastic band 110 may have a width ranging from 2.0 cm to 3.0 cm. The plurality of side panels 106 are sized so that a portion of each of the side panels 106 can be tucked underneath the mattress 102 of variable size and held in place by the horizontal force (γ) exerted by the elastic band 110. The height of each side panel 106, hereinafter referred to as drop of the fitted sheet 100 is selected based on the thickness of the mattress 102 as illustrated in Table 1 of FIG. 3.

As illustrated in FIGS. 1*a* and 1*c*, a plurality of gripping elements 112 are secured to each of the plurality of corners 108, respectively. In an exemplary embodiment of the present invention, each gripping element 112 is secured at a distance of not less than 5 cm above the elastic band 110. In another exemplary embodiment of the present invention, the gripping element 112 is secured at a minimum drop of the fitted sheet 100, i.e. if the thickness of the mattress is between 30 cm and 50 cm. The gripping element 112 is secured at a distance of around 20 cm or more, above the elastic band 110. In an embodiment of the present invention, the gripping element 112 is secured to each of the plurality of corners 108 by stitching. While stitching the gripping element 112, stitching type, thread type and needle type may be optimised for best seam appearance, grip quality and durability, as per stitching thread, needle type, needle number and fabric quality. Further, any combination of stitching type, thread type and needle type may be used while stitching the gripping element 112.

Each gripping element 112 extends along the respective corner 108 such that a portion 112*a* of the gripping element 112 is engageable with one side panel 106 associated with the corner 108 and other portion 112*b* of the gripping element 112 is engageable with the adjacent side panel 106 associated with the corner 108. In another embodiment of the present invention, the gripping element 112 may be secured to any surface of the fitted sheet 100 which requires enhanced gripping.

Each gripping element 112 comprises a horizontal elastic strip 114 and an inverted V shaped elastic segment 116 attached with the horizontal elastic strip 114. Each horizontal elastic strip 114 extends laterally along the two adjacent side panels 106 of the respective corners 108. In another embodiment of the present invention, the horizontal elastic strip 114 may include two equal segments 114*a*, 114*b* stitched together at the edge of the respective corner 108, such that each segment extends laterally along the two adjacent side panels 106 of respective corners 108. The inverted V shaped elastic segment 116 is an elastic element having a width equal to or less than the width of the horizontal elastic strip 110. In an exemplary embodiment of the present invention, the width of the horizontal elastic strip 110 may be in the range of 2.0 cm to 5.0 cm and the length may be in the range of 20 cm to 60 cm.

The inverted V shaped elastic segment 116 includes at least two arms 116*a*, 116*b*. In an exemplary embodiment of the present invention, the length of each arm may be in the range of 18 cm to 36 cm. In a stretched state, the at least two arms 116*a*, 116*b* of the inverted V subtend an angle (2ω) at a vertex (C). The two arms 116*a*, 116*b* of the inverted V shaped elastic segment 116 are disposed diagonally along the adjacent side panels 106 associated with the corresponding corners 108, respectively. In particular, the at least two arms 116*a*, 116*b* are disposed at an angle (θ) in relation to the horizontal elastic strip 114 in the stretched state. A distal portion of each arm 116*a*, 116*b* is attached with two halves 114*a*, 114*b* of the horizontal elastic strip 114 respectively. In an embodiment of the present invention, a lower edge of each arm 116*a*, 116*b* is attached with respective halves 114*a*,

114*b* of the horizontal elastic strip 114. In an embodiment of the present invention, a midpoint 114*c* of the horizontal elastic strip 114 is in line with the vertex (C) of the inverted V shaped segment 116 dividing the gripping element in two portions 112*a* and 112*b* substantially equal in length. The inverted V shaped segment 116 and the horizontal elastic strip 110 are heat set and have an elasticity greater than or equal to 200%.

Referring to FIGS. 1*a* and 1*c*, the vertex (C) of the inverted V shaped segment of each gripping element 112 is attached to a top edge (108*a*) of the corresponding corner 108. Each of the plurality of gripping elements 112 exerts horizontal forces (β) and diagonal forces (α) such that the resultant forces cause an increase in gripping effect and prevents the fitted sheet from crumpling. Further, the resultant forces prevent dog ear or seam ear formation at respective corner 108.

Figure 2:
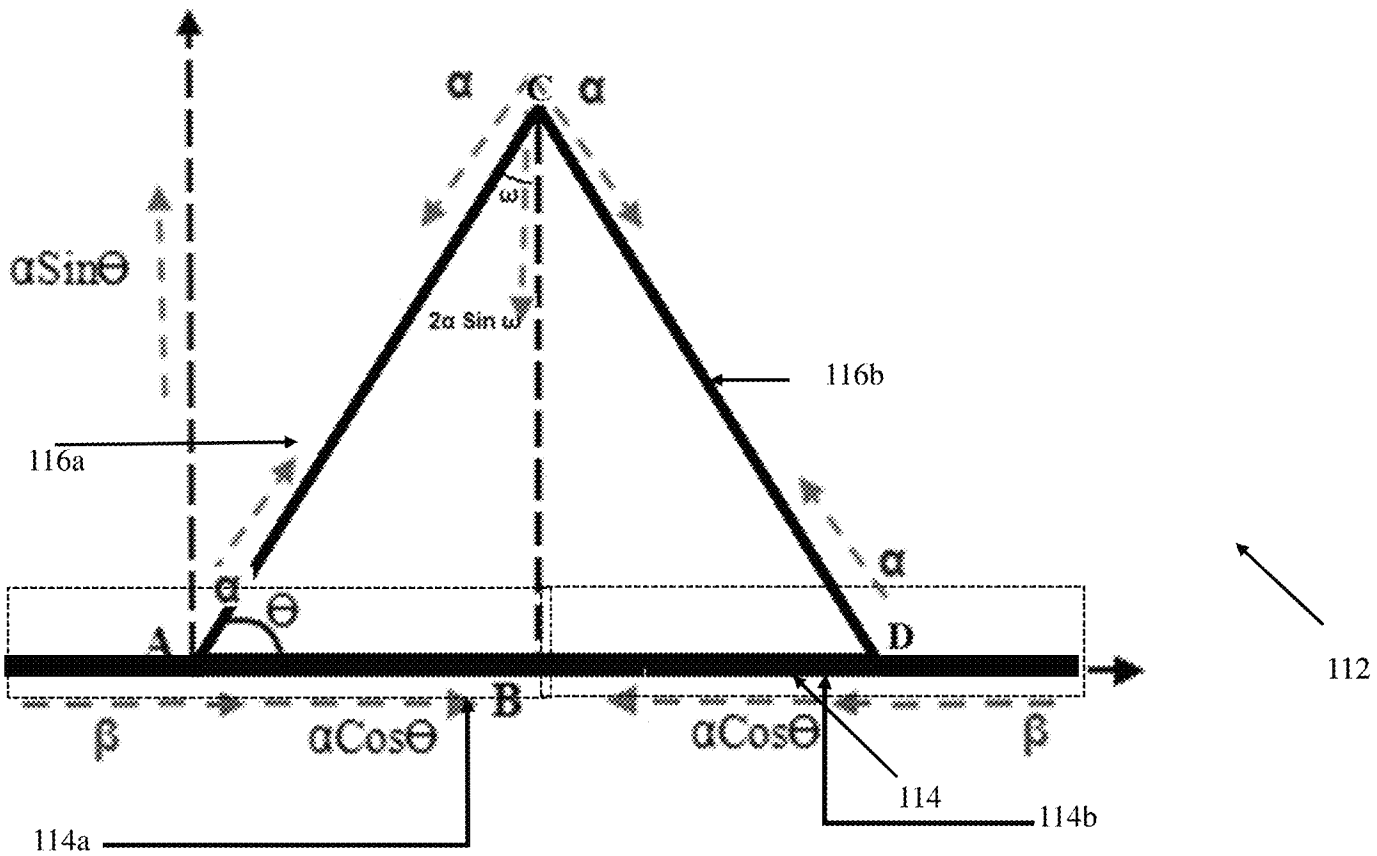
FIG. 2 illustrates the force components generated by the elastic band and respective gripping elements in horizontal and vertical direction, in accordance with an embodiment of the present invention.

FIG. 2 illustrates the force components generated by the elastic band and respective gripping elements in horizontal and vertical direction, in accordance with an embodiment of the present invention.

In an embodiment of the present invention, when the sheet 100 is fitted on to the mattress 102 the elastic band 110 and the plurality of gripping elements 112 elongate and exert horizontal and vertical forces. Each inverted V shaped elastic segment 116 of the gripping element 112 at respective corners 108, exerts a vertical pulling force that pulls the fitted sheet 100 downwards and keeps the fitted sheet stabilized over the top panel 104 of the mattress 102. The horizontal elastic strip 114 of the gripping element 112 extending along the two adjacent side panels 106 of respective corners 108 exerts the frictional resistance against the mattress 102, providing stability to fitted sheet 100 over the mattress 102. The resultant forces exerted by the horizontal and vertical force causes an increase in gripping effect and prevents the fitted sheet from crumpling and formation of dog ears.

In operation, as illustrated in FIG. 1 in an embodiment of the present invention, the elastic band 110 generates horizontal force γ which holds the fitted sheet 100 underneath the mattress 102. The horizontal elastic strip 114 of the gripping element 112 exerts horizontal force β in the horizontal direction at corresponding corner 108. In particular, the two halves 114*a*, 114*b* of the horizontal elastic strip 114 generates horizontal forces β and the diagonal arms 116*a*, 116*b* of the inverted V shaped segment 116 generates diagonal forces α.

As illustrated in FIG. 2, at point A, the diagonal arm 116*a* exerts a horizontal force $\alpha\cos\theta$ and a vertical force $\alpha\sin\theta$. The force components $\alpha\cos\theta$ and $\alpha\sin\theta$ pulls the fitted sheet in horizontal and vertical directions respectively. The resultant horizontal pulling force acting at point A in the horizontal direction away from the corner 108, hereinafter referred to as F1 is the sum of horizontal forces β and $\alpha\cos\theta$.

$F1=\beta+\alpha\cos\theta$.

Similarly the resultant horizontal force at point D, hereinafter referred to as F2 is the sum of β and $\alpha\cos\theta$.

$F2=\beta+\alpha\cos\theta$.

For example, for a mattress 102 of thickness 16", the length of the diagonal arm 116*a* (AC) is 36 cm and the height from the midpoint 114*c* (B) to vertex (C) of the inverted V segment (BC) is 34 cm and θ=71°. In an exemplary embodiment of the present invention, at point C, each of the two arms 116*a* and 116*b* generates horizontal and vertical force components $\alpha\cos\omega$ and $\alpha\sin\omega$, respectively. The vertical force component $\alpha\sin\omega$ acts in the downward direction. The resultant of the vertical force components is hereinafter referred to as F3, where $F3=2\alpha\sin\omega$. F3 pulls the top panel 104 of the fitted sheet downwards and prevents crumpling and dog ear formation. The forces F1, F2 and F3 act at each corner 108 of the fitted sheet 100.

In an embodiment of the present invention, the angle θ formed between diagonal arms 116*a*, 116*b* and the respective halves 114*a*, 114*b* of the horizontal elastic strips 114 increases with an increase in the thickness of the mattress 102. The increase in the value of angle θ leads to an increase in the vertical force component of diagonal force α exerted by each arm 116*a*, 116*b*, as explained below.

FIG. 3 illustrates a Table 1 depicting varying drop values of the fitted sheet for varying thickness values of the mattresses, in accordance with an embodiment of the present invention. As illustrated in table 1 with reference to FIG. 2, as the thickness of the mattress 102 increases, length of arms (116*a*, 116*b*) AB and BD of the inverted V shaped segment 116 increases and the length (BC) increases. Subsequently force α will increase due to longer length of arms 116*a*, 116*b*. Consequently, angle θ increases and angle ω decreases. As a result, the resultant forces F1, F2 and F3 is caused to maintain an equilibrium, which prevents crumpling of the top panel 104 and dog ear formation at the corner 108. In an exemplary embodiment of the present invention, the value of θ ranges from 40° to 70°.

It may be understood that the gripping element 112 disclosed herein can be readily incorporated into any existing fitted sheet, car covers, table cloths and the like.

Advantageously, in accordance with various embodiments of the present invention, the gripping element 112, aids in improving the grip of the fitted sheet 100 at the respective corners 108. Further, as demonstrated above, the gripping element 112 prevents dog ear formation and crumpling of the fitted sheet 100.

While the exemplary embodiments of the present invention are described and illustrated herein, it will be appreciated that they are merely illustrative. It will be understood by those skilled in the art that various modifications in form and detail may be made therein without departing from the scope of the invention except as it may be described by the following claims.

I claim:

1. A fitted sheet for mattresses, comprising:

a top panel and a plurality of side panels, the side panels extending contiguously along a periphery of the top panel, the top panel and the plurality of side panels defining an open ended body including a plurality of corners formed by edges of the top panel and two adjacent side panels, each of the plurality of side panels including an elastic band extending along the respective side panels, and a plurality of gripping elements secured to each of the plurality of corners, respectively, such that a portion of the gripping element is engageable with one side panel and other portion of the gripping element is engageable with the adjacent side panel, each gripping element comprising a horizontal elastic strip and an inverted V shaped elastic segment attached to the horizontal elastic strip, each horizontal elastic strip extending laterally along the corresponding adjacent side panels, at least two arms of the inverted V shaped segment disposed diagonally along the side panels, respectively, and are disposed at an angle in relation to the horizontal elastic strip, a midpoint of the horizontal elastic strip is in line with a vertex of the inverted V elastic segment dividing the gripping element into the two portions, wherein each of the plurality of gripping elements and the one or more elastic bands exerts horizontal and vertical forces such that the resultant forces cause an increase in gripping effect and prevents the fitted sheet from crumpling and prevents dog ear formation at each corner.

2. The fitted sheet as claimed in claim 1, wherein the plurality of gripping elements are secured to respective corners at a distance of not less than 5 cm above the elastic band.

3. The fitted sheet as claimed in claim 1, wherein the two portions are equal in length.

4. The fitted sheet as claimed in claim 1, wherein the vertex of each gripping element is secured to the top edge of the respective corner.

5. The fitted sheet as claimed in claim 1, wherein the elastic band extends along the lower edges of the respective side panels.

6. The fitted sheet as claimed in claim 1, wherein the width of the elastic band is in the range 2.0 cm to 3.0 cm and the elasticity is equal to or greater than 200%.

7. A gripping element, each gripping element comprising an horizontal elastic strip and an inverted V shaped elastic segment attached to the horizontal elastic strip, each horizontal elastic strip extendable laterally along a surface, at least two arms of the inverted V shaped segment disposed diagonally along the surface at an angle in relation to the horizontal elastic strip, a midpoint of the horizontal elastic strip is in line with a vertex of the inverted V elastic segment dividing the gripping element into two portions, wherein the gripping element exerts horizontal and vertical forces which cause an increase in gripping effect.

8. The gripping element as claimed in claim 7, wherein a length of the horizontal elastic strip is in the range of 20-60 cm and width of the horizontal elastic strip is in the range of 2.0 to 3.0 cm.

9. The gripping element as claimed in claim 7, wherein inverted V shaped elastic segment includes at least two arms and the length of each arm is in the range of 18 cm to 36 cm.

10. The gripping element as claimed in claim 7, wherein a width of the inverted V shaped elastic segment is equal to or less than the width of the horizontal elastic strip.

11. The gripping element as claimed in claim 7, wherein elasticity of the inverted V shaped elastic segment and the horizontal elastic strip is equal to or greater than 200%.

* * * * *